US005379599A

United States Patent [19]

Mostello

[11] Patent Number: 5,379,599

[45] Date of Patent: Jan. 10, 1995

[54] PUMPED LIQUID OXYGEN METHOD AND APPARATUS

[75] Inventor: Robert A. Mostello, Somerville, N.J.

[73] Assignee: The BOC Group, Inc., New Providence, N.J.

[21] Appl. No.: 109,960

[22] Filed: Aug. 23, 1993

[51] Int. Cl.[6] ..... F25J 3/02

[52] U.S. Cl. ..... 62/25; 62/38; 62/41

[58] Field of Search ..... 62/41, 25, 38

[56] References Cited

U.S. PATENT DOCUMENTS

| | | | |
|---|---|---|---|
| 2,597,385 | 5/1952 | Schilling | 62/41 |
| 2,730,870 | 1/1956 | Steele | 62/41 |
| 3,100,696 | 8/1963 | Becker | 62/13 |
| 3,210,950 | 10/1965 | Lady | 62/21 |
| 4,303,428 | 12/1981 | Vandenbussche | 62/13 |
| 4,560,397 | 12/1985 | Cheung | 62/28 |
| 4,869,741 | 9/1989 | McGuinness et al. | 62/24 |

*Primary Examiner*—Ronald C. Capossela
*Attorney, Agent, or Firm*—David M. Rosenblum; Larry R. Cassett

[57] ABSTRACT

A process and apparatus for producing a gaseous oxygen product at a delivery pressure so as to contain a low concentration of heavy impurities in which compressed and purified air is cooled in a main heat exchanger to near dew point temperatures and then introduced into an air separation unit designed to rectify the air into a liquid oxygen fraction. The air separation unit comprises high and low pressure columns operatively associated with one another in a heat transfer relationship by provision of a condenser-reboiler. The liquid phase of the air being separated becomes increasingly more concentrated in heavy impurities as it descends within the low pressure column so that liquid oxygen collected in the sump of the condenser-reboiler becomes concentrated in the heavy impurities and the liquid phase flowing into the sump contains a low concentration of the heavy impurities. A product stream is withdrawn from the liquid phase before it reaches the sump and is pumped to the delivery pressure and then vaporized within the main heat exchanger. A purge stream of liquid oxygen from the sump is removed so that the impurity concentration level within the liquid oxygen does not reach its solubility limit.

8 Claims, 1 Drawing Sheet

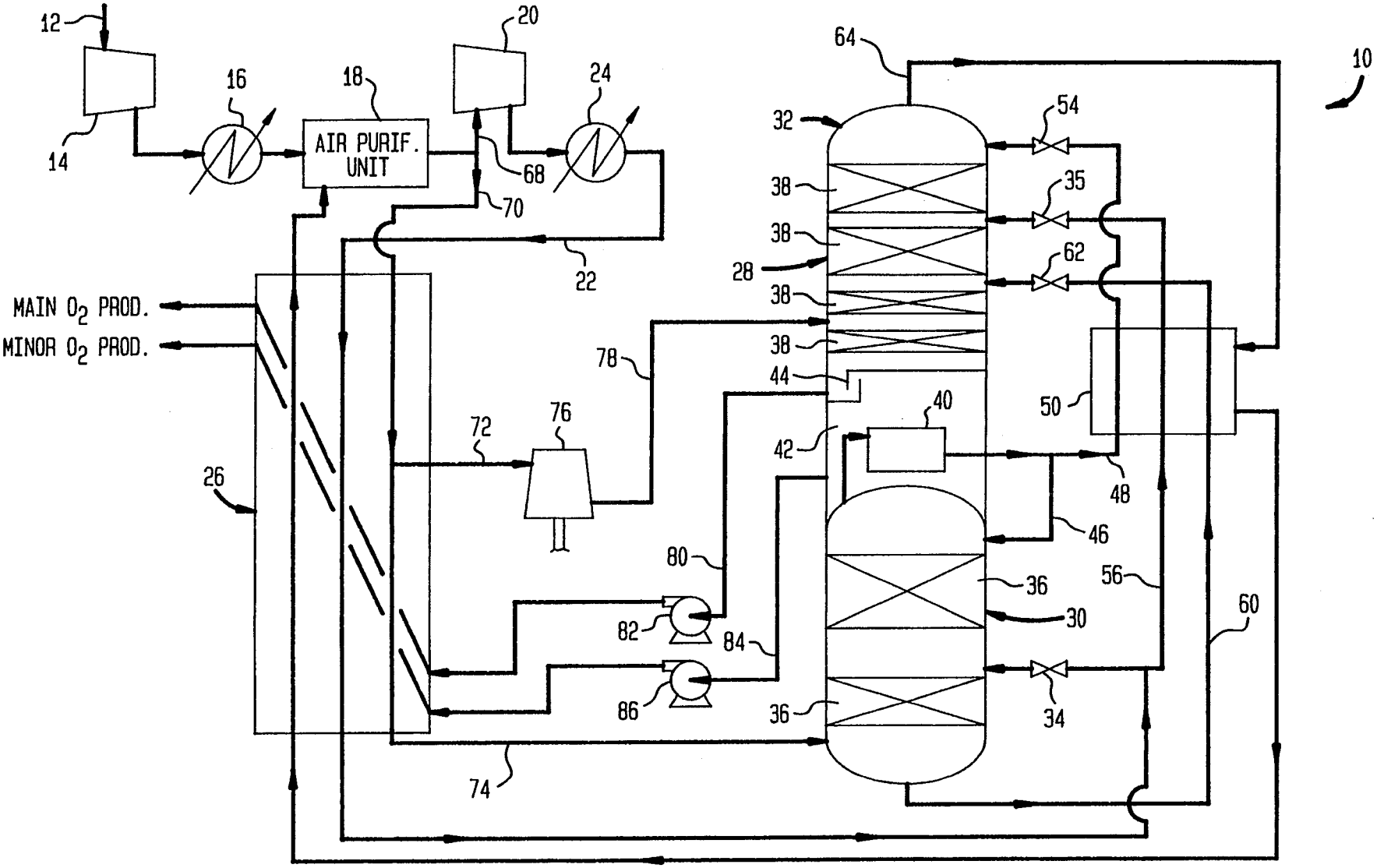
10
12
14
16
18
AIR PURIF. UNIT
20
22
24
26
28
30
32
34
35
36
38
40
42
44
46
48
50
54
56
60
62
64
68
70
72
74
76
78
80
82
84
86
MAIN $O_2$ PROD.
MINOR $O_2$ PROD.

PUMPED LIQUID OXYGEN METHOD AND APPARATUS

BACKGROUND OF THE INVENTION

The present invention relates to a process and apparatus for producing a gaseous oxygen product at a delivery pressure by rectifying air. More particularly, the present invention relates to such a process and apparatus in which liquid oxygen is pumped to the delivery pressure and then vaporized within a main heat exchanger. Even more particularly, the present invention relates to such a process and apparatus in which the gaseous oxygen product is produced with a low concentration of heavy impurities.

In cryogenic air separation plants that produce gaseous oxygen at a delivery pressure by vaporizing pumped liquid oxygen within a main heat exchanger, heavy impurities such as carbon dioxide and hydrocarbons can exceed their solubility limits in the liquid oxygen as it vaporizes. As a result, carbon dioxide contained within the liquid oxygen can solidify to plug heat exchange passageways within the main heat exchanger and hydrocarbons such as acetylene can come out of solution to present a safety hazard. This occurs because the heavy impurities such as carbon dioxide and hydrocarbons have a much lower vapor pressure than oxygen and as such, tend to concentrate in liquid oxygen being produced within the air separation plant. When the liquid oxygen is raised to a higher pressure by pumping and then vaporized by being heated within the main heat exchanger of the air separation plant, the resulting vaporization temperature increases the vapor pressures of the heavy impurities to a degree greater than the oxygen vapor pressure increase and hence, the heavy impurities vaporize sooner before the liquid oxygen is fully vaporized.

Heavy impurity concentrations can be maintained below their solubility limit during the vaporization process by pumping the liquid oxygen to a higher delivery pressure. However, as the delivery pressure increases, the compression of the air being cooled within the main heat exchanger must also increase to maintain a positive temperature difference within the main heat exchanger. It is generally uneconomical from an energy standpoint to deliver oxygen at a higher pressure than required just to prevent heavy impurities from exceeding their solubility limits.

As will be discussed, the present invention provides a process and apparatus for the separation of air to produce a gaseous oxygen product at a delivery pressure with a low level of heavy impurity concentration and without delivering the product at a higher than necessary delivery pressure.

SUMMARY OF THE INVENTION

The present invention provides a process for producing a gaseous oxygen product at a delivery pressure and so as to contain a low concentration of heavy impurities. As used herein and in the claims, heavy impurities include carbon dioxide and such hydrocarbons as acetylene. These heavy impurities are but examples of those that create problems in air separation plants. Carbon dioxide can plug up heat exchanger tubes and acetylene can present an explosion hazard during the production of oxygen.

In accordance with the method, air is compressed and, after removal of the heat of compression, is purified. The air is cooled within a main heat exchanger to a temperature suitable for its rectification. The air is then introduced into a double rectification column so that the air is rectified. The double rectification column includes high and low pressure columns operatively associated with one another in a heat transfer relationship by provision of a condenser-reboiler having a sump. Each of the high and low pressure columns have contacting elements for contacting an ascending vapor phase having an ever-increasing nitrogen concentration as the vapor phase ascends with a descending liquid phase having an ever-increasing oxygen and heavy impurity concentration as the liquid phase descends. In the low pressure column, liquid oxygen having a high concentration of heavy impurities collects in the sump of the condenser-reboiler. The liquid phase flowing into the sump, though, has a low concentration of the heavy impurities. Refrigeration is introduced into the process so that heat balance within the process is maintained. A major liquid oxygen stream is withdrawn from the low pressure column, which is composed of the liquid phase flowing to the sump of the condenser-reboiler. The major liquid oxygen stream is pumped to a delivery pressure and is then vaporized within the main heat exchanger to produce the gaseous oxygen product. A purge liquid oxygen stream, composed of the liquid oxygen collected in the sump of the condenser-reboiler, is withdrawn from the low pressure column such that the heavy impurities do not concentrate in the liquid oxygen at a level above their solubility limit.

In another aspect, the present invention provides an apparatus for rectifying air to produce a gaseous oxygen product at a delivery pressure and so as to contain a low concentration of heavy impurities. The apparatus comprises means for compressing and for purifying the air. A main heat exchange means is connected to the compressing and purifying means for cooling the air to a temperature suitable for its rectification against vaporizing a pumped liquid oxygen stream forming the gaseous oxygen product. A means is provided for introducing refrigeration into the apparatus and thereby maintaining the apparatus in heat balance. A double column air separation unit is provided having high and low pressure columns operatively associated with one another in a heat transfer relationship by provision of a condenser-reboiler having a sump. Each of the high and low pressure columns have contacting elements for contacting an ascending vapor phase having an ever-increasing nitrogen concentration as the vapor phase ascends with a descending liquid phase having an ever-increasing oxygen and heavy impurity concentration as the liquid phase descends. In the low pressure column, liquid oxygen having a high concentration of the heavy impurities collects in the sump of the condenser-reboiler and the liquid phase flowing into the sump has a low concentration of the heavy impurities. A pump is connected between the main heat exchange means and the low pressure column such that the liquid oxygen composed of the liquid phase flowing to the sump is pumped to the delivery pressure and thereby forms the liquid oxygen stream. A means is provided for withdrawing the liquid oxygen collected in the sump of the condenser-reboiler such that the heavy impurities do not concentrate in the liquid oxygen at a level above their solubility limit.

Since heavy impurity concentration within the liquid oxygen being vaporized within the main heat exchanger is low enough to begin with, vaporization of the heavy impurities within the main heat exchanger does not contribute to any equipment or safety hazards.

It should be noted that the term "main heat exchanger" as used herein and in the claims does not necessarily mean a single, plate fin heat exchanger. A "main heat exchanger" as would be known to those skilled in the art, could be made of several units working in parallel to cool and warm streams. The use of high and low pressure heat exchangers is conventional in the art. Additionally, the terms "fully cooled" and "fully warmed" as used herein and in the claims main cooled to rectification temperature and warmed to ambient, respectively. The term "partially" in the context of being partially warmed or cooled as used herein and in the claims indicates the warming or cooling to a temperature between fully warmed and cooled.

BRIEF DESCRIPTION OF THE DRAWINGS

While the specification concludes with claims distinctly pointing out the subject matter that applicant regards as his invention, it is believed that the invention will be better understood when taken in conjunction with the accompanying drawings in which the sole figure is a schematic of an apparatus used in practicing a method in accordance with the present invention.

DETAILED DESCRIPTION

With reference to the figure, an apparatus 10 for carrying out a method in accordance with the present invention is illustrated. In apparatus 10, an air stream 12 after having been filtered is compressed by a main compressor 14. Thereafter, heat of compression is removed by a first aftercooler 16 and the air is purified by an air purification unit 18 in which carbon dioxide, moisture and hydrocarbons are substantially removed from the air. As will be discussed, a certain amount of carbon dioxide and other heavy impurities such as hydrocarbons remain in the air.

Apparatus 10 is designed to deliver a gaseous oxygen at a delivery pressure. This is accomplished by pumping liquid oxygen to the requisite pressure. In order to vaporize the oxygen product, the air is further compressed in a high pressure air compressor 20 to form a further compressed air stream 22. After having been further compressed, the heat of compression is removed from further compressed air stream 22 by a second aftercooler 24. Further compressed air stream 22 is then cooled in a main heat exchanger 26 to a temperature suitable for its rectification, which in practice would be at or near its dew point temperature. The further compression of the air is necessary to vaporize a highly pressurized oxygen product. It is to be noted that the present invention has equal applicability to an air separation plant in which the product is delivered at a lower pressure. In such case the air would not have to be further compressed.

Air stream 24 is then introduced into a double column air separation unit 28 having high and low pressure columns 30 and 32 after being suitably reduced to high and low pressure column pressures by Joule-Thompson valves 34 and 35.

Each of the high and low pressure columns 30 and 32 are provided with contacting elements, designated by reference numeral 36 for the high pressure column and 38 for low pressure column 32. Contacting elements 36 and 38 (sieve plates, trays, structured or random packings) are utilized to contact descending vapor and liquid phases. In each column, as the vapor phase ascends through the packing elements it becomes increasingly more concentrated in nitrogen as it ascends and the liquid phase becomes increasingly more concentrated in oxygen as it descends. In high pressure column 30, an oxygen-enriched liquid column bottom, termed in the art crude liquid oxygen, and a nitrogen-enriched vapor tower overhead are formed. The nitrogen-enriched vapor tower overhead is condensed to form liquid nitrogen by a condenser-reboiler 40 having a sump 42 in low pressure column 32. In low pressure column 32, as the liquid phase becomes more concentrated in the less volatile oxygen, it also becomes more concentrated in the heavy impurities. These heavy impurities concentrate in the liquid oxygen that collects within sump 42 of condenser-reboiler 40. The liquid oxygen is vaporized by condenser-reboiler 40 against the condensation of the nitrogen-enriched vapor tower overhead in high pressure column 30. In the illustrated embodiment, trays are used and liquid descends from tray to tray by downcomers of which downcomer 44 is illustrated. The liquid phase passing from downcomer 44 prior to the time it reaches sump 42 contains significantly a significantly lower concentration of the heavy impurities than the liquid oxygen collected in sump 42 of condenser-reboiler 40.

The liquid nitrogen from condenser-reboiler 40 is used to reflux high pressure column 30 by provision of a stream 46 and low pressure column 42 by provision of a stream 48. Stream 48 is subcooled within a subcooler 50, reduced to the pressure of low pressure column 32 by provision of a Joule-Thompson valve 54 and introduced into low pressure column 32. An air stream 56, representing a portion of air stream 22, is also subcooled in subcooler 50 prior to its expansion and introduction into low pressure column 32. A crude liquid oxygen stream 60, composed of the crude liquid oxygen column bottoms, is withdrawn from high pressure column 30, subcooled in subcooler 50, reduced in pressure to that of the low pressure column by a Joule-Thompson valve 62 and introduced into low pressure column 32 for further refinement. A nitrogen vapor stream 64 composed of the nitrogen vapor tower overhead produced within low pressure column 32 is partially warmed in subcooler 50 by heat transfer with nitrogen reflux stream 48, air stream 56, and crude liquid oxygen stream 60 in order to subcool the same. Waste nitrogen stream 64 then passes through main heat exchanger 26 where it fully warms and where, preferably, it is used in regenerating air purification unit 18. It can also, in whole or part, be expelled from the system.

In order to keep apparatus 10 in heat balance, refrigeration is supplied through air expansion. To this end, air stream 12 is divided into first and second subsidiary streams 68 and 70. First subsidiary stream 68 is compressed by high pressure air compressor 20. The second subsidiary stream 70 after having been partially cooled is divided into first and second partial streams 72 and 74 by provision of an intermediate outlet of main heat exchanger 26. First partial stream 72 is expanded by a turboexpander 76 which performs expansion work which is either discharged or used in compression of the air to form a turboexpanded stream 78 which is introduced into low pressure column 32 to supply refrigeration and thereby maintain apparatus 10 in heat balance. It is understood that the present invention would have equal applicability to a nitrogen expansion plant. Second partial stream 74 is fully cooled within main heat exchanger 26 and then, introduced into the bottom of high pressure column 30 for rectification.

In order to produce the gaseous oxygen product, the liquid phase flowing to the sump is withdrawn from low pressure column 32 at downcomer 44 as a major liquid oxygen stream 80 which after withdrawal is pumped by a liquid oxygen pump 82 to the delivery pressure. Major liquid oxygen stream 80 is then vaporized within main heat exchanger 26. It is to be noted here that in case of structured packing, a major liquid oxygen stream would be withdrawn from a liquid collector at the same location as downcomer 44. In order to prevent the heavy impurities from climbing above their solubility limits in the liquid oxygen by interfering with the air separation or creating a safety hazard, liquid oxygen is removed from sump 42 of condenser-reboiler 40 as a purge liquid oxygen stream 84 which is pumped to a higher pressure than the delivery pressure by a pump 86. Purge liquid oxygen stream 84 then is vaporized within main heat exchanger 26. The high pressure pumping of purge liquid oxygen stream 84 guarantees that the impurities will vaporize with the oxygen within main heat exchanger 26. The pumped liquid oxygen stream 80 after vaporization becomes the main gaseous oxygen product and the pumped purge liquid oxygen stream 84 becomes a minor gaseous oxygen product. The major and minor gaseous oxygen products can be combined and delivered to the customer. However, since in a properly designed case, the minor oxygen product will amount to about 5% of the liquid oxygen product, it can also simply be purged from apparatus 10 or stored as a liquid (without pumping and vaporization) for some other use.

EXAMPLE

The following is a calculated example of the operation of apparatus 10. In apparatus 10, high pressure column is provided with 30 theoretical stages. Second partial stream 74 from main heat exchanger 26 enters main heat exchanger below stage 30 and a portion of the compressed air stream 24 is introduced as liquid into stage 24. Stream 48 is withdrawn from high pressure column 30 at the top stage thereof.

The low pressure column 32 has 40 theoretical stages and stream 48 is subcooled in subcooler 50 and introduced into top stage, stage 1, of low pressure column 32. Crude liquid oxygen 60 after having been subcooled in subcooler 50 is introduced onto stage 25. The balance the further compressed air stream 22, namely air stream 56, after having been subcooled in subcooler 50, is introduced onto stage 15 of low pressure column 32. Turbo-expanded stream 78 is introduced into low pressure column 32 above stage 28.

TABLE

| Stream | Flow ($Nm^3$/min) | Temp (°C.) | Pressure bara | % $O_2$ |
|---|---|---|---|---|
| Air stream 12 after air pre-purification unit 18 | 1000 | 26.7 | 5.52 | 21 |
| Further compressed air stream 22 | 300 | 26.7 | 10.34 | 21 |
| Second subsidiary stream 70 | 75 | 26.7 | 5.52 | 21 |
| Second partial stream 74 | 625 | −173.3 | 5.45 | 21 |
| Portion of further compressed air stream 22 introduced into high pressure column 30 | 75 | −173.3 | 10.2 | 21 |
| First partial stream 72 | 75 | −101.1 | 5.45 | 21 |
| Portion of further compressed stream 22 introduced into low pressure column 30 | 75 | −147.7 | 1.48 | 21 |
| Stream 48 before subcooling | 300 | −178.2 | 5.38 | 0.0 |
| Crude oxygen liquid stream 60 before subcooling | 400 | −174.0 | 5.45 | 36.7 |
| Air stream 56 before subcooling | 225 | −173.3 | 10.2 | 21 |
| Main liquid oxygen stream 80 (before pumping) | 210 | −179.7 | 1.50 | 95.0 |
| Purge liquid oxygen stream 84 before pumping | 10 | −179.3 | 1.50 | 97.1 |
| Main $O_2$ product | 210 | 24.3 | 3.66 | 95.0 |
| Minor $O_2$ product | 10 | 24.3 | 10.3 | 97.1 |
| Waste nitrogen stream 64 after fully warmed within main heat exchanger 26 | 780 | 24.3 | 1.27 | 0.06 |

It is to be noted that main oxygen product has a $CO_2$ concentration of about 0.058 vpm and purge oxygen product has a $CO_2$ concentration of about 2.5 vpm. These conditions under the scope of the present invention have the following effect when air stream 12, after having been purified in air pre-purification unit 18 contains about 0.037 vpm $CO_2$. In a conventional plant the liquid oxygen product from the low pressure column will contain about 0.17 vpm of dissolved carbon dioxide. The liquid oxygen would have to be pumped to at least 5.31 bara before vaporizing in order to prevent precipitation of $CO_2$ in main heat exchanger 26. This would require further compressed air stream 22 to be compressed to greater than 10.34 bara.

In accordance with the present invention, most of the liquid oxygen is pumped to only 3.79 bara and only a small amount to 10.4 bara (purge stream 84). A further compressed air stream 22 of 10.34 bara is adequate to ensure vaporization of both major and purge liquid oxygen streams 80 and 84 in the main heat exchanger without carbon dioxide freeze out and to keep the carbon dioxide in condenser-reboiler 40 below its solubility limit.

While the invention has been described with reference to a preferred embodiment, as will occur to those skilled in the art that numerous changes and omissions can be made without departing from the spirit and scope of the present invention.

I claim:

1. A process for producing a gaseous oxygen product at a delivery pressure and so as to contain a low concentration of heavy impurities, said process comprising:

compressing the air, removing heat of compression from the compressed air, and purifying the air;

cooling the air within a main heat exchanger to a temperature suitable for its rectification;

introducing the further compressed air stream into a double rectification column so that the air is rectified, said double rectification column including high and low pressure columns operatively associated with one another in a heat transfer relationship by provision of a condenser-reboiler having a sump, each of the high and low pressure columns having contacting elements for contacting an ascending vapor phase having an ever increasing nitrogen concentration as the vapor phase ascends with a descending liquid phase having an ever increasing oxygen and heavy impurity concentrations as the liquid phase descends such that, in the low pressure column, liquid oxygen having a high concentration of the heavy impurities collects in the sump of the condenser-reboiler and the liquid phase flowing to the sump has the low concentration of the heavy impurities;

introducing refrigeration into the process so that heat balance within the process is maintained;

withdrawing a major liquid oxygen stream from the low pressure column composed of the liquid phase flowing to the sump of the condenser-reboiler, pumping it to the delivery pressure, and vaporizing said liquid oxygen stream within the main heat exchanger to produce said gaseous oxygen product;

withdrawing a purge liquid oxygen stream from the low pressure column composed of the liquid oxygen collected in the sump of the condenser-reboiler such that the heavy impurities do not concentrate in the liquid oxygen at a level above their solubility limit;

pumping the purge liquid oxygen stream to a sufficiently high pressure level that the heavy impurities will vaporize substantially with the liquid oxygen contained within said purge liquid oxygen stream; and vaporizing the purge liquid oxygen stream within the main heat exchanger.

2. The method of claim 1, further comprising:

further compressing at least a portion of the air to form a further compressed air stream;

cooling the air of the further compressed air stream within a main heat exchanger to the temperature suitable for its rectification; and introducing the air into a double rectification column.

3. The method of claim 2, wherein:

the purge liquid oxygen stream is pumped to a sufficiently high pressure level that the heavy impurities will vaporize substantially with the liquid oxygen contained within said purge liquid oxygen stream; and the purge liquid oxygen stream is vaporized in the main heat exchanger.

4. The method of claim 2, wherein:

after purification of the air, the air is divided into first and second subsidiary streams;

the first subsidiary is compressed to form said further compressed stream;

the second subsidiary stream is partially cooled in the main heat exchanger and divided into first and second partial streams;

the first partial stream is fully cooled and introduced into the high pressure column for rectification of the air contained therein;

the further pressurized stream is subjected to a reduction in pressure, and divided into two portions which are respectively is introduced into the high and low pressure columns for the rectification of the air contained therein;

one of the two portions of the further compressed stream that is introduced into the low pressure column being subcooled and reduced in pressure to low pressure column pressure prior to its introduction thereto; and the second partial stream is expanded with the performance of work to low pressure column pressure and is introduced into the low pressure column for the rectification of the air contained therein and to introduce the refrigeration into the process.

5. The method of claim 4, wherein:

the descending liquid phase within the high pressure column collects as an oxygen enriched column bottom and the ascending vapor phase produced an nitrogen enriched tower overhead within the high pressure column;

the nitrogen enriched tower overhead is condensed against evaporating the liquid oxygen collected in the sump of the low pressure column;

the ascending vapor phase within the low pressure column produces a nitrogen vapor tower overhead in the low pressure column;

a crude liquid oxygen stream is withdrawn from the low pressure column, subcooled, pressure reduced to the low pressure column pressure and introduced into the low pressure column for further refinement;

a liquid nitrogen stream composed of the condensed nitrogen enriched tower overhead is withdrawn from the condenser-reboiler and divided into two liquid nitrogen partial stream, one of said two liquid nitrogen partial streams is supplied to the high pressure column as reflux and the other of the two liquid nitrogen partial streams is subcooled, pressure reduced to the low pressure column pressure and introduced into the low pressure column as reflux; and a waste nitrogen stream composed of the nitrogen vapor tower overhead is withdrawn from the low pressure column, partially warmed against subcooling the crude liquid oxygen, the one of the two portions of the further compressed air stream, and the other of the two liquid nitrogen partial streams, and is fully warmed in the main heat exchanger.

6. The method of claim 5, wherein:

the contacting elements comprise trays having downcomers;

the major liquid oxygen stream is withdrawn from the downcomer associated with a first of the trays located directly above the condenser-reboiler.

7. An apparatus for rectifying air to produce a gaseous oxygen product at a delivery pressure and so as to contain a low concentration of heavy impurities, said apparatus comprising:

means for compressing and for purifying the air;

main heat exchange means connected to the compressing and purifying means for cooling the air to a temperature suitable for its rectification against vaporizing a pumped liquid oxygen stream forming the gaseous oxygen product;

means for introducing refrigeration into the apparatus and thereby maintaining the apparatus in heat balance;

a double column air separation unit connected to the main heat exchange means and having high and low pressure columns operatively associated with one another in a heat transfer relationship by provision of a condenser-reboiler having a sump, each of the high and low pressure columns having contacting elements for contacting an ascending vapor phase having an ever increasing nitrogen concentration as the vapor phase ascends with ascending liquid phase having an ever increasing oxygen and heavy impurity concentrations as the liquid phase descends such that, in the low pressure column, liquid oxygen having a high concentration of the heavy impurities collects in the sump of the condenser-reboiler and the liquid phase flowing to the sump has the low concentration of the heavy impurities;

a first pump connected between the main heat exchange means and the low pressure column such that liquid oxygen composed of the liquid phase flowing to the sump is pumped to the delivery pressure and thereby forms the pumped liquid oxygen stream; and a second pump connected between the main heat exchange means and the sump of the condenser-reboiler for withdrawing the liquid oxygen collected in the sump of the condenser-reboiler such that the heavy impurities do not concentrate in the liquid oxygen at a level above their solubility limit and for pumping the withdrawn liquid oxygen to a sufficient pressure such that heavy impurities present within said liquid oxygen collected in the sump of the condenser-reboiler vaporize within the main heat exchanger upon vaporization of the liquid oxygen.

8. The apparatus of claim 7, wherein:

the compressing and purifying means comprises:

a main compressor for compressing the air;

a first aftercooler connected to the main compressor for removing heat of compression from the air;

purification means connected to the first aftercooler for purifying the air;

a high pressure air compressor connected to the purification means; and a second after cooler connected to the high pressure air compressor;

the main heat exchange means are also connected to the purification means so that a first compressed subsidiary air stream formed by the main compressor is further compressed in the high pressure air compressor to form a further compressed stream and a second compressed subsidiary air stream formed by the main compressor is fully cooled within a main heat exchange means;

the second aftercooler is connected to the main heat exchange means so that the further compressed stream is fully cooled within the main heat exchange means;

the main heat exchange means also has an intermediate outlet so that part of the second compressed subsidiary air stream being cooled is withdrawn after the compressed second subsidiary stream has been partially cooled to form a first partial stream and the balance of the compressed second subsidiary air stream being fully cooled forms a second partial stream;

the refrigeration means comprises a turboexpander connected between the low pressure column and the intermediate outlet of the main heat exchange means for expanding the first partial stream with the performance of expansion work;

the main heat exchange means is connected to the high pressure column so that the second partial stream is introduced into a bottom location of the high pressure column and two portions of the further compressed stream are introduced into the high and low pressure columns at intermediate levels thereof; and two Joule-Thompson valves are interposed between the main heat exchange means and the high and low pressure columns so that the respective of the two portions of the further compressed stream are reduced in pressure to high and low column pressures prior to their introduction into the high and low pressure columns.

* * * * *